US007687731B2

(12) United States Patent
Ozawa

(10) Patent No.: US 7,687,731 B2
(45) Date of Patent: Mar. 30, 2010

(54) ILLUMINATED PUSH BUTTON UNIT

(75) Inventor: Ryosuke Ozawa, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 259 days.

(21) Appl. No.: 11/855,533

(22) Filed: Sep. 14, 2007

(65) Prior Publication Data

US 2008/0068844 A1 Mar. 20, 2008

(30) Foreign Application Priority Data

Sep. 14, 2006 (JP) ..... 2006-249634

(51) Int. Cl.
*H01H 9/00* (2006.01)

(52) U.S. Cl. ..... 200/314; 362/311.01; 362/555

(58) Field of Classification Search ..... 362/555, 362/551, 311.01; 200/314, 310, 317
See application file for complete search history.

(56) References Cited

U.S. PATENT DOCUMENTS 3,644,855 A * 2/1972 Cherry et al. ..... 335/205
4,017,700 A * 4/1977 West ..... 200/314
5,367,133 A * 11/1994 Schmidt et al. ..... 200/5 A
6,855,899 B2 * 2/2005 Sotome ..... 200/317
7,193,170 B2 * 3/2007 Katayama et al. ..... 200/314

FOREIGN PATENT DOCUMENTS

JP 09-069322 A 3/1997
JP 09-282972 A 10/1997
JP 2004-214101 A 7/2004
JP 2005-243322 A 9/2005

* cited by examiner

*Primary Examiner*—Gunyoung T Lee
(74) *Attorney, Agent, or Firm*—Global IP Counselors, LLP

(57) ABSTRACT

An illuminated push button unit includes a light-guide lens, a lens holder and a push-down control. The light-guide lens is configured to guide light from a light source to a light emission face disposed at a front end of the light-guide lens and emit the light from the light emission face. The lens holder is attached to the light-guide lens. The lens holder includes a light emission window through which the light emission face of the light-guide lens emits the light. The push-down control is attached to the light emission face in a middle of the light emission face so that the light emission face emits the light in an annular shape.

18 Claims, 4 Drawing Sheets

ILLUMINATED PUSH BUTTON UNIT

CROSS-REFERENCE TO RELATED APPLICATIONS

This application claims priority to Japanese Patent Application No. 2006-249634 filed on Sep. 14, 2006. The entire disclosure of Japanese Patent Application No. 2006-249634 is hereby incorporated herein by reference.

BACKGROUND OF THE INVENTION

1. Field of the Invention

The present invention relates to an illuminated push button unit. More specifically, the present invention relates to an illuminated push button unit in which light from a light source is emitted around a push-down control.

2. Background Information

A conventional illuminated push button unit is formed such that a light emission face is displaced along with a pushing down of a push-down control. With the illuminated push button unit, a light emission window that faces the light emission face is provided in an external housing of an electrical device in which the illuminated push button unit is mounted.

As shown in FIG. 6, the illuminated push button unit U includes a light-guide lens 1 and a lens holder 5. The light-guide lens 1 is made of a translucent resin. The light-guide lens 1 includes a light emission face 2 formed by a front end face of the light-guide lens 1. The light-guide lens 1 is affixed to the lens holder 5. The lens holder 5 is made of an opaque resin. The lens holder 5 is integrally provided with a light emission window 6, a push-down control 7, a hinge 8 and a switch pressing tab 9. The light emission window 6 faces the light emission face 2. The push-down control 7 is a protruding shaft.

With the illuminated push button unit U, the push-down control 7 is provided in a middle of the light emission window 6 of the lens holder 5. When the push-down control 7 is pushed in, the light-guide lens 1 is displaced along with the lens holder 5, with the hinge 8 as a fulcrum. When switching is performed by operation of a tact switch (not shown) by the switch pressing tab 9 of the lens holder 5, a light source such as an LED (not shown) is lit. The light from the LED is guided through the light-guide lens 1 to the light emission face 2. Then, the light exiting the light emission face 2 is emitted through the light emission window 6 of the lens holder 5.

As shown in FIG. 7, the lens holder 5 is integrally equipped with the push-down control 7 provided in the middle of the light emission window 6. To locate the push-down control 7 in the middle of the light emission window 6, the push-down control 7 is integrated with the lens holder 5 via short ribs 5*a* that extend inward from a plurality of places (two places in FIG. 7) around a periphery of the light emission window 6 of the lens holder 5.

Accordingly, with the illuminated push button unit U, the light emission window 6 ends up being partitioned into two small windows 6*a* by the ribs 5*a* at two locations. Therefore, even though the light is emitted circularly by the light emission face 2 of the light-guide lens 1, the ribs 5*a* create a shadow. As a result, the light is emitted discontinuously from the two small windows 6*a* of the light emission window 6. In other words, even though it is intended to obtain a ring of light by having a basic circular shape of the light emission window 6, and emitting light all the way around the push-down control 7, the ribs 5*a* end up creating a shadow. As a result, only arc-shaped light that is discontinuous between the small windows 6*a* is actually obtained. Thus, a completely continuous ring of light is not obtained.

In view of the above, it will be apparent to those skilled in the art from this disclosure that there exists a need for an improved illuminated pushed button unit. This invention addresses this need in the art as well as other needs, which will become apparent to those skilled in the art from this disclosure.

SUMMARY OF THE INVENTION

The present invention was conceived in light of the above problems. It is one object of the present invention to provide an illuminated push button unit with which light is emitted from a light emission face in a continuous ring shape.

In accordance with one aspect of the present invention, an illuminated push button unit includes a light-guide lens, a lens holder and a push-down control. The light-guide lens is configured to guide light from a light source to a light emission face disposed at a front end of the light-guide lens and emit the light from the light emission face. The lens holder is attached to the light-guide lens. The lens holder includes a light emission window through which the light emission face of the light-guide lens emits the light. The push-down control is attached to the light emission face in a middle of the light emission face so that the light emission face emits the light in an annular shape.

With the illuminated push button unit, it is possible to provide an illuminated push button unit with which light is emitted from the light emission face in a continuous ring shape.

These and other objects, features, aspects and advantages of the present invention will become apparent to those skilled in the art from the following detailed descriptions, which, taken in conjunction with the annexed drawings, discloses selected embodiments of the present invention.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

First Embodiment

Figure 1:
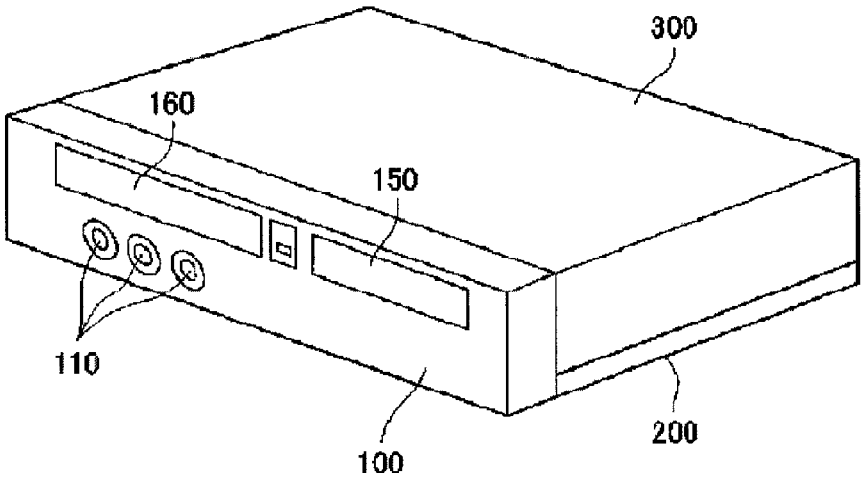
FIG. 1 is a simplified oblique view of an electrical device in which an illuminated push button unit pertaining to a first embodiment of the present invention is employed.

FIG. 1 is a simplified oblique view of a DVD and VCR combination device in which an illuminated push button unit U1 of the present invention is installed. It will be apparent to one of ordinary skill in the art from this disclosure that the illustrated push button unit U1 can be used with any electrical device.

Figure 2:
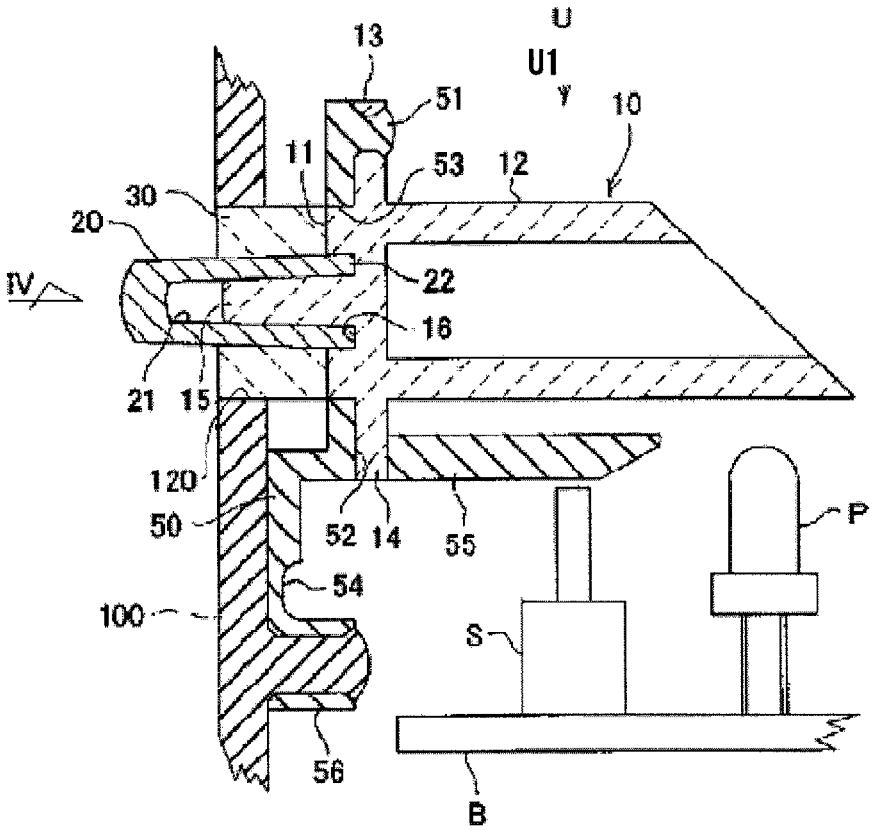
FIG. 2 is a vertical cross section of the illuminated push button unit pertaining to the first embodiment of the present invention.
Figure 4:
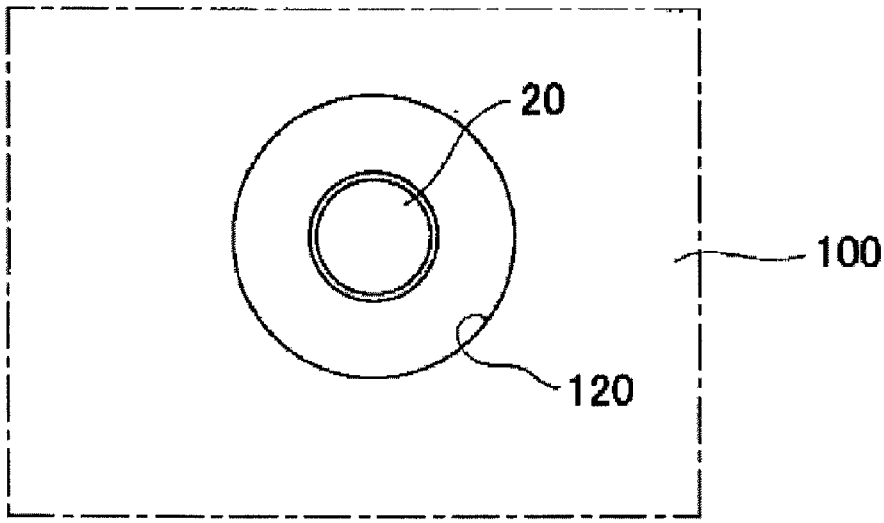
FIG. 4 is a detail view of the illuminated push button unit in the IV arrow direction of FIG. 2.

As shown in FIG. 1, the electrical device includes a front panel 100, a bottom chassis 200 and a top case 300. An external housing of the electrical device is formed in the shape of a flat box by the front panel 100, the bottom chassis 200 and the top case 300. The front panel 100 is equipped with push button switches 110, a disk loading opening 150 and a magnetic tape cassette loading opening 160. Furthermore, on the front panel 100, a circular opening 120 is formed as shown in FIGS. 2 and 4. The push button switches 110 include the illuminated push button unit U1.

As shown in FIG. 2, the illuminated push button unit U1 includes a light-guide lens 10, a push-down control 20, a translucent body 30 and a lens holder 50.

The light-guide lens 10 is made transparent from a resin that is translucent. The light-guide lens 10 includes a light emission face 11, a light-guide component 12, attachment tabs 13 and 14, an attachment shaft 15 and an annular groove 16.

The light emission face 11 is formed at a front end face of the light-guide lens 10. The light emission face 11 has a circular outline. The light emission face 11 is integrally provided with the light-guide component 12. The light-guide component 12 is formed cylindrically. The light-guide component 12 is located concentrically with the light emission face 11. The attachment tabs 13 and 14 stick out from two places in a peripheral direction at a front end of the light-guide component 12. More specifically, the attachment tabs 13 and 14 protrude radially outwardly from an outer periphery of the light-guide component 12. The attachment shaft 15 protrudes integrally from a middle of the front end face of the light-guide lens 10. The attachment shaft 15 has a tapered peripheral surface. The annular groove 16 is formed in the light-guide lens 10 around a base of the attachment shaft 15.

Figure 3:
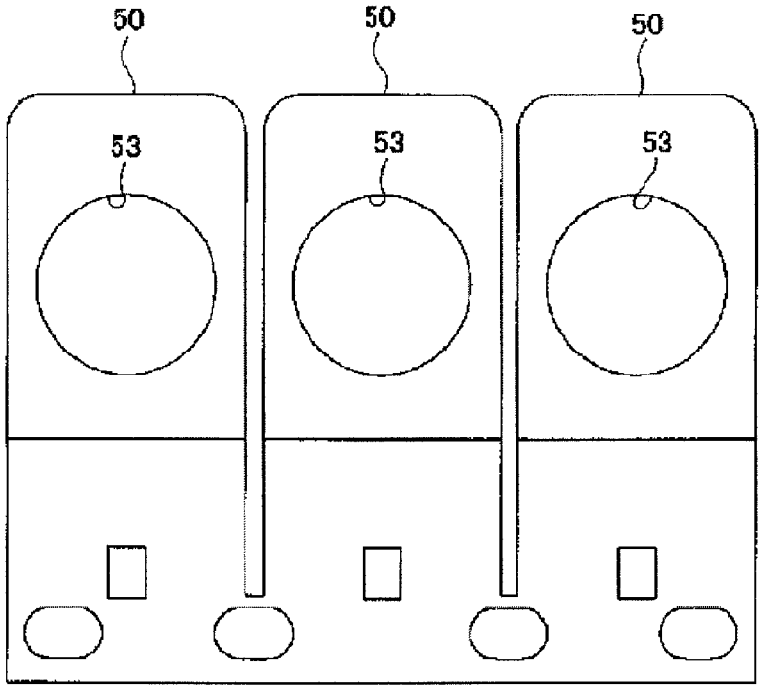
FIG. 3 is a front view of a lens holder of the illuminated push button unit pertaining to the first embodiment of the present invention.

The lens holder 50 includes a boss 51, an engagement hole 52, a light emission window 53, a hinge 54, a switch depressing tab 55 and a fusion attachment component 56. The boss 51 is affixed by fusion to the attachment tab 13. The engagement hole 52 latches the attachment tab 14. Specifically, the attachment tab 14 is latched by being inserted into the engagement hole 52. As shown in FIG. 3, the light emission window 53 is formed in a circular shape in the lens holder 50. The front end of the light-guide lens 10 is inserted in this light emission window 53 so that the light emission face 11 faces the light emission window 53. The hinge 54 serves as a fulcrum of the lens holder 50 when the lens holder 50 is pushed in. The switch depressing tab 55 depresses a tact switch S when the lens holder 50 is pushed in. The fusion attachment component 56 is coupled by being fused to a back side of the front panel 100 of the electrical device. The circular opening 120 formed in the front panel 100 has substantially the same size as the circular light emission window 53. The circular opening 120 is formed in the front panel 100 at a place across from the light emission window 53.

The push-down control 20 is formed as a convex shaft. The push-down control 20 faces the circular opening 120 of the front panel 100. The push-down control 20 is configured to be pushed down from the front side of the front panel 100.

The push-down control 20 is made of a resin that is opaque. The push-down control 20 and the light-guide lens 10 are formed independently from one another. In other words, the push-down control 20 and the light-guide lens 10 are separately formed. The push-down control 20 is coupled to the light-guide lens 10. Specifically, the attachment shaft 15 is press fitted and fixed in a hole 21 formed in the push-down control 20. Furthermore, a proximal end portion 22 of the push-down control 20 is fitted into the annular groove 16. Since the illuminated push button unit U1 has the opaque push-down control 20 protruding from a middle of the light emission face 11 of the light-guide lens 10, the light emission face 11 of the light-guide lens 10 emits in a complete ring shape all the way around the push-down control 20.

When the user pushes down on the push-down control 20 from the front side of the front panel 100 with the finger, the lens holder 50 is displaced along with the light-guide lens 10. As a result, the switch depressing tab 55 of the lens holder 50 presses the tact switch S. When switching is performed by operation of the tact switch S by the switch depressing tab 55, a light source P such as an LED (light emitting element) is lit. The tact switch S and the light source P are mounted on a wiring board B, as shown in FIG. 2. When the light source P is lit, the light radiates radially inward from an outside of the light-guide component 12 to the light-guide lens 10. The light is guided to the light emission face 11. At the light emission face 11, a middle part of the light is blocked by the push-down control 20 disposed in the middle of the light emission face 11. However, the light is emitted around the periphery of the push-down control 20. Furthermore, the emitted light passes through the circular opening 120 in the front panel 100 and is visible from the outside. Therefore, the user sees a completely circular, continuous ring of light.

The translucent body 30 is provided to plug the gap produced between the front panel 100 and the front face of the lens holder 50. The translucent body 30 is made from a translucent resin. The translucent body 30 is formed in a cylindrical shape. The translucent body 30 is mated with the front panel 100. Specifically, the translucent body 30 is fitted into the circular opening 120 of the front panel 100. The push-down control 20 penetrates the translucent body 30 and is pushed in relative to the translucent body 30. The translucent body 30 is superposed with the light emission face 11 of the light-guide lens 10. Therefore, a front end face of the translucent body 30 substantially emits ring-shaped light.

Figure 6:
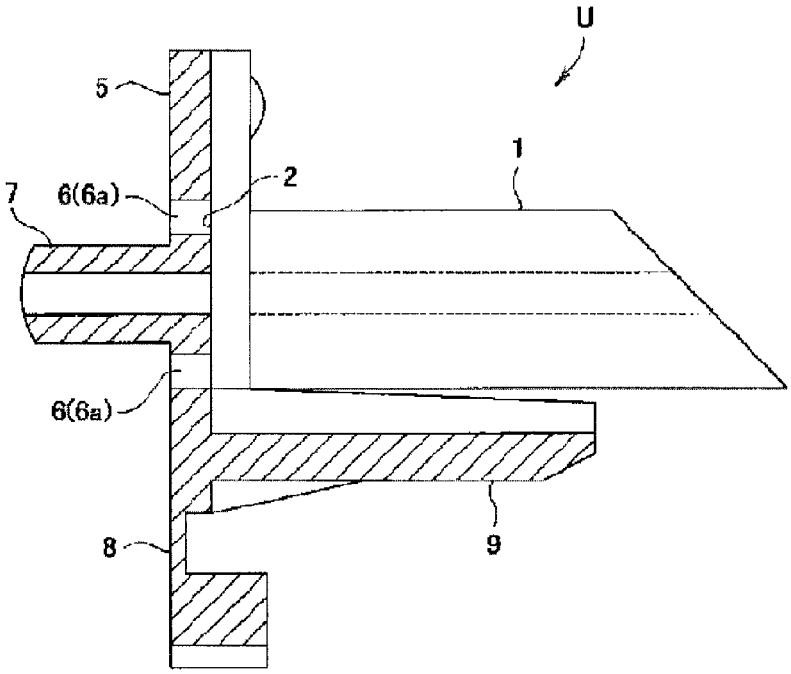
Prior Art FIG. 6
FIG. 6 is a vertical cross section of a conventional illuminated push button unit.
Figure 7:
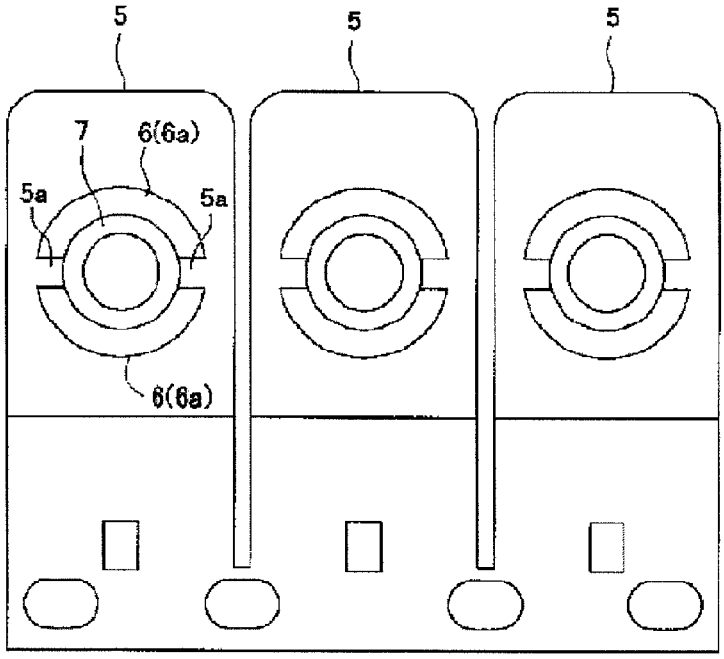
Prior Art FIG. 7
FIG. 7 is a front view of a lens holder of the unit of the conventional illuminated push button unit in FIG. 6.

When the illuminated push button unit U1 is compared to the conventional illuminated push button unit U shown in FIGS. 6 and 7, the ribs 5*a* are omitted. Furthermore, the push-down control 20 is separated from the lens holder 50. As a result, the light emission window 53 is formed as a single circular opening. Therefore, the plurality of small windows 6*a* of the conventional illuminated push button unit U is eliminated.

With the illuminated push button unit U1, the push-down control 20 is disposed on the light-guide lens 10, and is not provided contiguously with the lens holder 50. Accordingly, no ribs have to be provided to the light emission window 53 of the lens holder 50 to integrate the push-down control 20 with the lens holder 50. As a result, the light emission window 53 is not partitioned into small windows by any ribs. Therefore, the light emitted through the light emission window 53 is formed in a completely continuous ring shape. Accordingly, when the illuminated push button unit U1 is applied to the electrical device, a completely continuous ring of light emission is obtained around the push-down control 20 at the places where push button switches 110 of the electrical device are installed. Therefore, the light shines attractively around the push button switches 110.

Furthermore, after the light-guide lens 10 and the push-down control 20 are individually formed from resins of different properties, the push-down control 20 is attached to the light-guide lens 10. Therefore, the coloring, design and so forth of the push-down control 20 can be freely selected without affecting the material or design of the light-guide lens 10. For instance, it is possible to impart light blocking properties to the push-down control 20, or to freely color the push-down control 20.

The attachment shaft 15 and the hole 21 are fixed together by press fitting the attachment shaft 15 in the hole 21. This allows the push-down control 20 to be integrally affixed to the light-guide lens 10 without employing any special linking means such as an adhesive agent.

The proximal end portion 22 of the push-down control 20 is fitted into the annular groove 16. As a result, the light emission face 11 is divided into a middle portion and the annular portion around the periphery of the middle portion.

Furthermore, the light-guide lens 10 is attached to the lens holder 50 with the attachment tabs 13 and 14. This allows the light-guide lens 10 to be attached to the lens holder 50 without employing any special linking means. Furthermore, since the light-guide component 12 is formed cylindrically, the light guided by the light-guide lens 10 is more readily focused on the light emission face 11.

Second Embodiment

Figure 5:
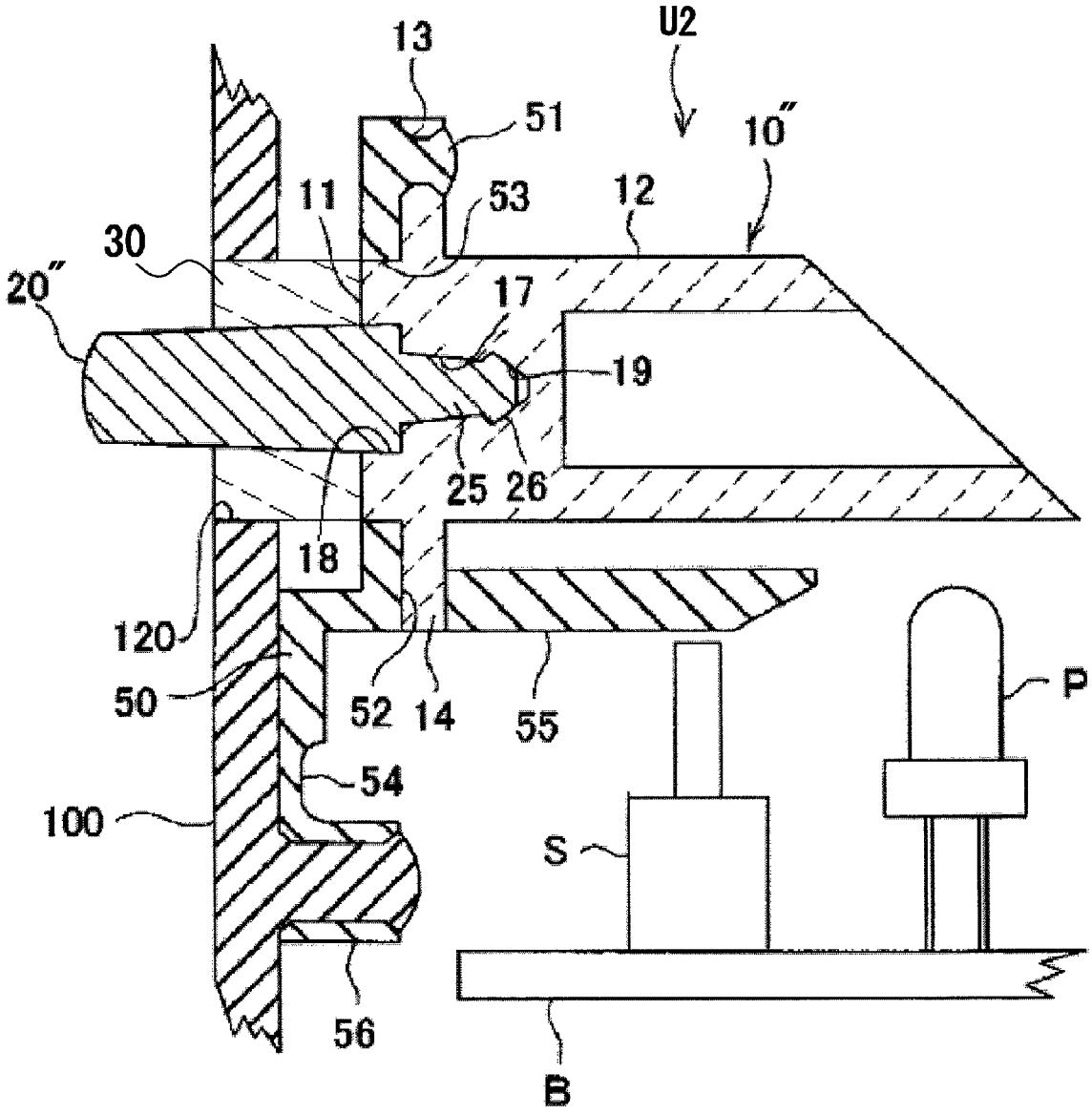
FIG. 5 is a vertical cross section of an illuminated push button unit pertaining to a second embodiment.

Referring now to FIG. 5, an illuminated push button unit U2 in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity. The parts of the second embodiment that differ from the parts of the first embodiment will be indicated with a double prime (").

A push-down control 20" of the second embodiment of the present invention is made of an opaque resin. The push-down control 20" is made of a softer resin than a resin forming a light-guide lens 10". The push-down control 20" is equipped with an attachment shaft 25 and a latching head 26. The attachment shaft 25 is press fitted and fixed into a hole 17 formed in the light-guide lens 10". The hole 17 is formed in an outwardly-widening tapered shape. The hole 17 is opening in a middle of the front end face of the light-guide lens 10". The latching head 26 is provided to an end of the attachment shaft 25. The latching head 26 is formed in a sagittate shape. The latching head 26 is engaged with a large-diameter bulge 19 provided at the bottom of the hole 17. Therefore, the push-down control 20" is prevented from coming loose. Also, a proximal end of the push-down control 20" is fitted into a circular recess 18 formed in the front end face of the light-guide lens 10". As a result, the light emission face 11 formed by the front end face of the light-guide lens 10" is formed in a circular shape that is completely continuous around the push-down control 20".

When the push-down control 20" is coupled to the light-guide lens 10", the engagement between the latching head 26 of the attachment shaft 25 and the bulge 19 of the hole 17 prevents the push-down control 20" from coming loose from the light-guide lens 10". Furthermore, the light guided by the light-guide lens 10" is more readily focused on the light emission face 11. As a result, the brightness of the light emission face 11 is increased.

General Interpretation of Terms

In understanding the scope of the present invention, the term "comprising" and its derivatives, as used herein, are intended to be open ended terms that specify the presence of the stated features, elements, components and groups, but do not exclude the presence of other unstated features, elements, components and groups. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the present invention, the following directional terms "forward, rearward, above, downward, vertical, horizontal, below and transverse" as well as any other similar directional terms refer to those directions of an image formation device equipped with the present invention. Accordingly, these terms, as utilized to describe the present invention should be interpreted relative to an image formation device equipped with the present invention as used in the normal operating position. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from the disclosures that various changes and modifications can be made herein without departing from the scope of the invention as defined in the appended claims. Furthermore, the foregoing descriptions of the selected embodiments according to the present invention are provided for illustration only, and not for the purpose of limiting the invention as defined by the appended claims and their equivalents.

What is claimed is:

1. An illuminated push button unit comprising:

a light-guide lens configured to guide light from a light source to a light emission face disposed at a front end of the light-guide lens and emit the light from the light emission face;

a lens holder configured to be pivotally attached to a front panel of an electrical device to support the light-guide lens relative to the front panel so that the light-guide lens pivots about a fulcrum portion of the lens holder relative to the front panel, the lens holder including a light emission window through which the light emission face of the light-guide lens emits the light;

a push-down control attached to the light emission face in a middle of the light emission face so that the light emission face emits the light in an annular shape, the push-down control having a tapered peripheral surface that tapers toward a distal end portion of the push-down control; and a cylindrical translucent body configured to be fixedly coupled to an opening of the front panel, the cylindrical translucent body being disposed on a front side of the front panel relative to the light emission face of the light-guide lens, the tapered peripheral surface of the push-down control being fitted within a through hole of the cylindrical translucent body and movable along the through hole of the cylindrical translucent body relative to the through hole of the cylindrical translucent body together with the light-guide lens when the light-guide lens pivots relative to the front panel.

2. The illuminated push button unit according to claim 1, wherein the light emission window is formed by a single circular opening.

3. The illuminated push button unit according to claim 2, wherein the push-down control is coupled to the light-guide lens by mating an attachment shaft provided to one of the push-down control and the light-guide lens into a hole provided to the other of the push-down control and the light-guide lens.

4. The illuminated push button unit according to claim 3, wherein the push-down control and the light-guide lens are fixed by press fitting the attachment shaft into the hole.

5. The illuminated push button unit according to claim 3, wherein a proximal end portion of the push-down control is fitted into an annular groove formed in the light emission face around a base of the attachment shaft.

6. The illuminated push button unit according to claim 4, wherein a proximal end portion of the push-down control is fitted into an annular groove formed in the light emission face around a base of the attachment shaft.

7. The illuminated push button unit according to claim 3, wherein the light-guide lens is integrally molded from a translucent resin, and the light-guide lens includes a light-guide component formed in a cylindrical shape, the light-guide component being configured to guide the light which radiates radially inward from the light source, an attachment tab provided to the light-guide component and attached to the lens holder.

8. The illuminated push button unit according to claim 7, wherein the push-down control and the light-guide lens are fixed by press fitting the attachment shaft into the hole.

9. The illuminated push button unit according to claim 7, wherein the light-guide component is located concentrically with the light emission face.

10. The illuminated push button unit according to claim 7, wherein the attachment tab is arranged to protrude radially outward from an outer periphery of the light-guide component.

11. The illuminated push button unit according to claim 7, wherein a proximal end portion of the push-down control is fitted into an annular groove formed in the light emission face around a base of the attachment shaft.

12. The illuminated push button unit according to claim 3, wherein the attachment shaft is provided to the light emission face so as to protrude from the light emission face, and the hole is provided to the push-down control.

13. The illuminated push button unit according to claim 12, wherein the push-down control and the light-guide lens are fixed by press fitting the attachment shaft into the hole.

14. The illuminated push button unit according to claim 12, wherein a proximal end portion of the push-down control is fitted into an annular groove formed in the light emission face around a base of the attachment shaft.

15. The illuminated push button unit according to claim 3, wherein the attachment shaft is provided to the push-down control, the hole is provided to the middle of the light emission face, and the attachment shaft is made of a resin softer than a resin from which the light-guide lens is formed.

16. The illuminated push button unit according to claim 15, wherein a proximal end of the push-down control is inserted into a recess formed in the light emission face.

17. The illuminated push button unit according to claim 1, wherein the push-down control and the lens holder are separately formed.

18. The illuminated push button unit according to claim 1, wherein the push-down control is molded from an opaque resin.

* * * * *